US008821355B2

(12) United States Patent
Daniels

(10) Patent No.: US 8,821,355 B2
(45) Date of Patent: Sep. 2, 2014

(54) ADJUSTABLE SKIPPING ROPE

(75) Inventor: James Daniels, Reading (GB)

(73) Assignee: James Daniels, Spencerswood, Reading (GB)

( * ) Notice: Subject to any disclaimer, the term of this patent is extended or adjusted under 35 U.S.C. 154(b) by 148 days.

(21) Appl. No.: 13/499,557

(22) PCT Filed: Oct. 4, 2010

(86) PCT No.: PCT/GB2010/051647

§ 371 (c)(1),
(2), (4) Date: Apr. 20, 2012

(87) PCT Pub. No.: WO2011/039549

PCT Pub. Date: Apr. 7, 2011

(65) Prior Publication Data

US 2012/0329612 A1 Dec. 27, 2012

(30) Foreign Application Priority Data

Oct. 2, 2009 (GB) ..... 0917288.3

(51) Int. Cl.
*A63B 5/20* (2006.01)
*A63B 21/00* (2006.01)

(52) U.S. Cl.
CPC ..... *A63B 5/20* (2013.01); *A63B 21/151* (2013.01); *A63B 21/1469* (2013.01); *A63B 21/1434* (2013.01)
USPC ..... 482/82

(58) Field of Classification Search
USPC ..... 482/44–46, 49, 81, 82, 92, 114, 118, 482/119, 121, 122, 124–126, 139; 473/424
See application file for complete search history.

(56) References Cited

U.S. PATENT DOCUMENTS

| | | | | |
|---|---|---|---|---|
| 1,538,844 | A | 5/1925 | Titus | |
| 3,419,270 | A | 12/1968 | Eppy | |
| 4,179,119 | A | 12/1979 | Wolf | |
| 4,205,839 | A | 6/1980 | Best | |
| 4,257,592 | A | 3/1981 | Jones | |
| 4,778,173 | A * | 10/1988 | Joutras | 482/82 |
| 5,224,910 | A * | 7/1993 | Deutsch | 482/82 |
| 6,440,043 | B1 * | 8/2002 | LaCoste | 482/82 |
| 6,551,222 | B1 * | 4/2003 | Beaver | 482/82 |

(Continued)

FOREIGN PATENT DOCUMENTS

| | | |
|---|---|---|
| GB | 161388 | 4/1921 |
| GB | 161388 A | 4/1921 |
| JP | 62090657 U | 6/1987 |

OTHER PUBLICATIONS

International Search Report issued on Jan. 20, 2011 in corresponding International Application No. PCT/GB2010/051647.

(Continued)

*Primary Examiner* — Justine Yu
*Assistant Examiner* — Garrett Atkinson
(74) *Attorney, Agent, or Firm* — Banner & Witcoff, Ltd.

(57) ABSTRACT

A skipping rope having at least one handle comprising an elongate hand grip, a mounting portion which is fixed to the hand grip and an attachment arrangement by which a rope or cord is affixed to the mounting portion, the attachment arrangement allowing the rope or cord to be secured to the mounting portion at any of a range of locations along its length.

20 Claims, 5 Drawing Sheets

(56) References Cited

U.S. PATENT DOCUMENTS

| | | | | |
|---|---|---|---|---|
| 8,033,962 | B2 * | 10/2011 | Veitch | 482/81 |
| 2005/0187077 | A1 * | 8/2005 | Daniel | 482/94 |
| 2007/0191195 | A1 * | 8/2007 | St. George et al. | 482/82 |

OTHER PUBLICATIONS

Search Report issued on Jan. 17, 2011 in corresponding GB Application No. GB0917288.3.

Search Report issued on Mar. 21, 2012 in corresponding GB Application No. GB1120816.2.

* cited by examiner

ADJUSTABLE SKIPPING ROPE

RELATED APPLICATION DATA

This application is a 371 National Stage Application of International Patent Application No. PCT/GB2010/051647 filed on Oct. 4, 2010, which application claims priority to GB Patent Application No. 0917288.3 filed on Oct. 2, 2009. Both patent applications are entirely incorporated herein by reference and made a part hereof.

This invention relates to exercise devices and more specifically to skipping ropes.

Skipping ropes are known in the art, and previous attempts have been made to improve their effectiveness. Standard skipping ropes have two handles with a rope of adequate length therebetween, to allow the rope to pass both over the head and subsequently under the feet of a user during skipping.

It is an object of the present invention to provide an improved skipping rope.

Accordingly, the present invention provides a skipping rope having at least one handle comprising an elongate grip, a mounting portion which is fixed to the grip, and an attachment arrangement by which a rope or cord is affixed to the mounting portion, the attachment arrangement allowing the rope or cord to be secured to the mounting portion at any of a range of locations along its length.

Preferably, the grip has a first and a second end, the mounting portion extends over the grip, and the grip and mounting portion define a space therebetween, in which the fingers or palm of a user may be accommodated Conveniently, the mounting portion extends from a point at or near the first end of the grip, to a point at or near the second end of the grip.

Advantageously, the attachment arrangement may slide along all or a part of the length of the mounting portion and may be locked in place at any point within this range of motion.

Preferably, the attachment arrangement may be locked into any one of a plurality of spaced apart attachment points along the length of the mounting portion.

Conveniently, the handle further comprises a brake assembly allowing the attachment arrangement to be releasably secured in position.

Advantageously, the brake assembly includes a control element to engage or release the brake assembly.

Preferably, the control element is provided on the grip.

Conveniently, the control element is in the form of a button, located such that the user presses the button when holding the grip during normal skipping.

Advantageously, the skipping rope further comprises a flexible member that may move within the handle and to which the attachment arrangement is fixed, wherein the brake assembly acts to prevent movement of the flexible member within the handle and thus substantially prevents movement of the attachment arrangement with respect to the mounting portion.

Preferably, the skipping rope has two handles and a length of rope or cord extending therebetween.

Another aspect of the present invention provides an exercise device handle, the handle comprising an elongate grip, a mounting portion which is fixed to the grip, an attachment arrangement by which a rope or cord is affixed to the mounting portion, and a brake assembly allowing the attachment arrangement to be releasably secured at a any of a range of locations along the length of the mounting portion, the brake assembly comprising a control element which may be manipulated to engage or release the brake assembly, the control element being located on the grip.

Preferably, the grip has a first and second end, wherein the mounting portion extends over the grip, and wherein the grip and mounting portions define a space therebetween, in which the fingers of palm of a user may be accommodated.

Conveniently, the mounting portion extends over the grip from a point at or near the first end of the grip, to a point at or near the second end of the grip.

Advantageously, the control element is biased toward an active position, in which the brake assembly is engaged.

Preferably, the control element is biased toward an inactive position, in which the brake assembly is disengaged.

Conveniently, the handle further comprises a flexible member that may move within the handle and to which the attachment arrangement is fixed, wherein the brake assembly acts to prevent movement of the flexible member within the handle and thus substantially prevents movement of the attachment arrangement with respect to the mounting portion.

Advantageously, the mounting portion of the handle is of a generally curved shape.

Preferably, the attachment arrangement may slide along all or part of a length of the mounting portion and may be locked in place at any point within this range of motion.

Conveniently, the location at which the attachment arrangement may be secured is one of a set of spaced-apart pre-defined locations.

Advantageously, the handle is incorporated into an exercise device.

Preferably, the exercise device is a skipping rope.

In order that the present invention may be more readily understood, embodiments thereof will now be described, by way of example, with reference to the accompanying drawings, in which.

Figure 1:
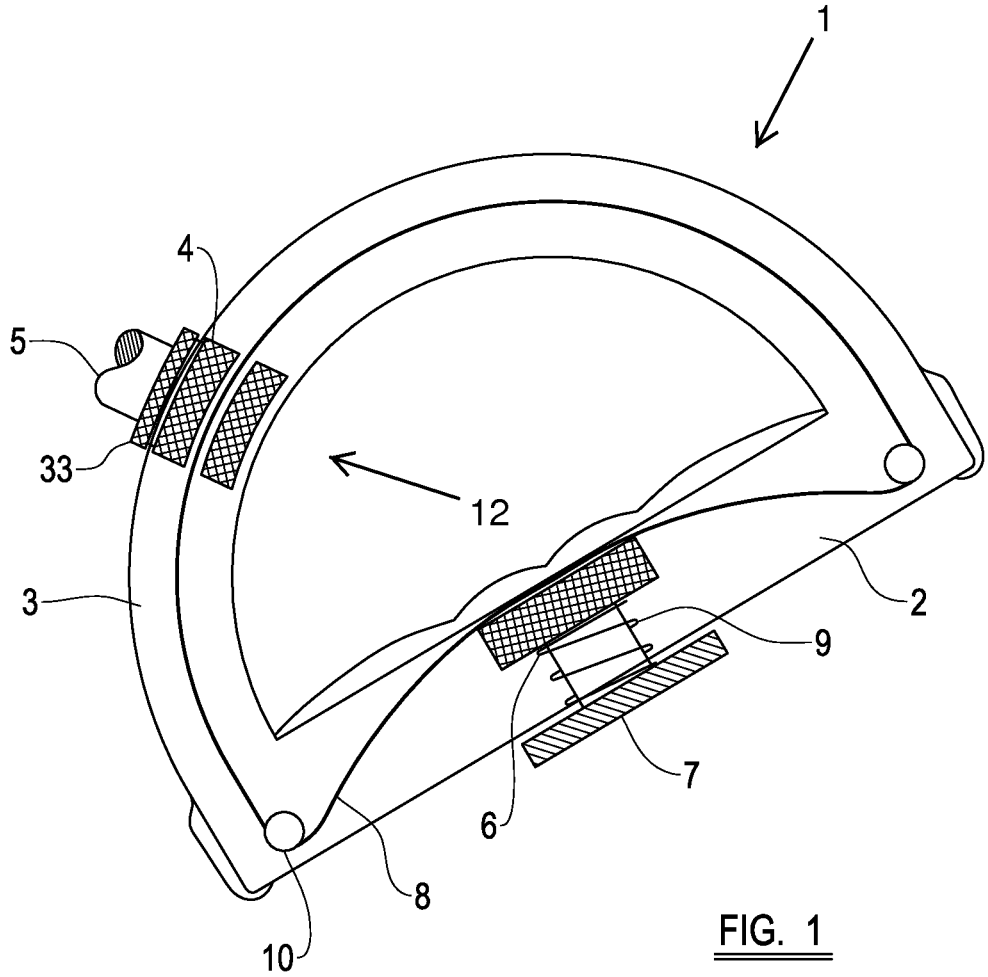
FIG. 1 shows a handle according to the present invention.

Referring firstly to FIG. 1, a handle for a skipping rope or other exercise device according to the present invention is shown.

The handle 1 comprises an elongate grip 2 which has first and second ends and which is adapted to be gripped by the hand of a user during skipping. The grip 2 may be generally cylindrical, but may also be shaped or mounted to improve the comfort or "ergonomic" feel of the grip 2. The handle 1 also has a mounting portion 3 which is attached to the grip 2 at the first and second ends thereof and arches over the grip 2. The mounting portion 3 may however be attached at only one of the first or second ends of the grip 2. The mounting portion 3 preferably has a curved shape, but may equally take a more angular shape, such as a half-octagon. A space 12 exists between the grip 2 and the mounting portion 3, the space 12 being sufficiently large to accommodate the fingers or palm of a user. Hence, a user may grasp the grip 2 in a normal manner, without this action being impeded by the mounting portion 3.

Figure 2:
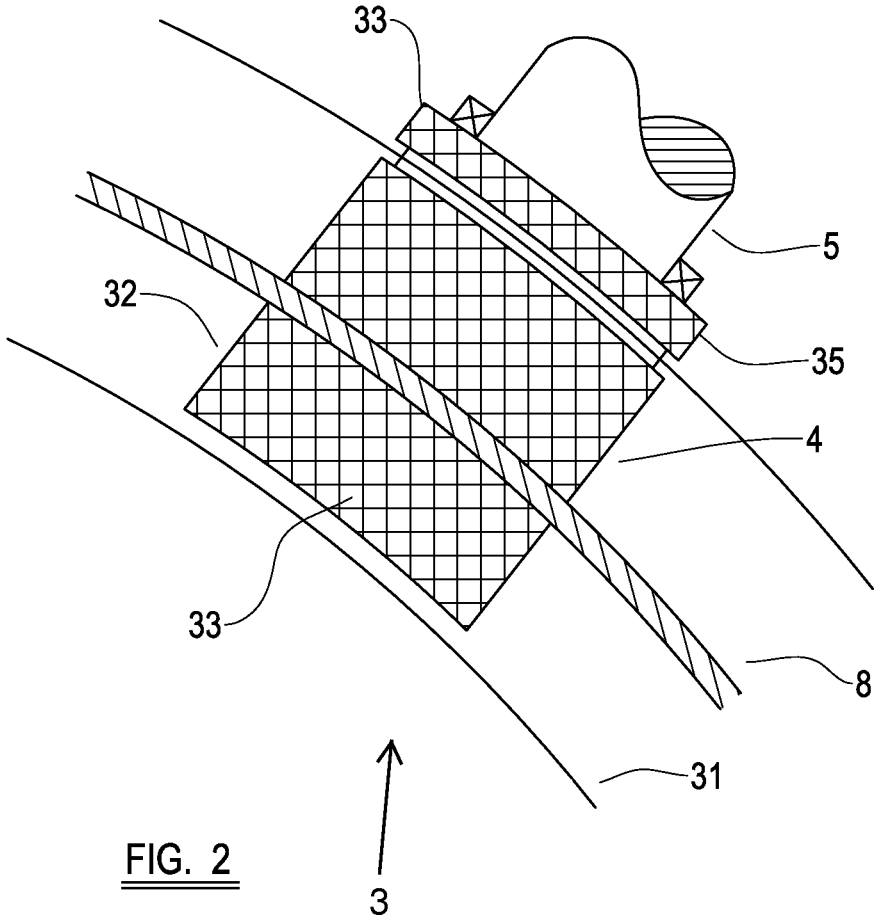
FIG. 2 shows a more detailed view of the attachment arrangement.

The handle 1 is generally hollow, and a slot (not visible in FIG. 1) runs along the outer edge of at least a substantial part of the mounting portion 3. The ends of the slot are, preferably, roughly aligned with the ends of the grip 2. An attachment arrangement 4 comprises a sliding member 32 which is received and retained within the mounting portion 3 and may slide along the length thereof. The attachment arrangement 4 further comprises a connection portion 33, which is located outside the outer edge of the mounting portion 3 and is connected to the sliding member 32 by a relatively narrow connection 35 (shown in FIG. 2) which passes through the slot. An inside surface 31 of the mounting portion 3 and/or the base of the sliding member 32 may be rubberised to increase the friction between them.

A rope or cord 5 is attached to the connection portion 33, and the rope or cord 5 can be attached to the connection portion 33 of the sliding member 32 in a number of ways. The cord may also be removably affixed to the connection portion 33, by means of a threaded attachment or any other convenient releasable connection method. In the example shown, the rope or cord 5 is crimped into the connection portion 33. The attachment arrangement 4 is shown in more detail in FIG. 2.

Figure 3:
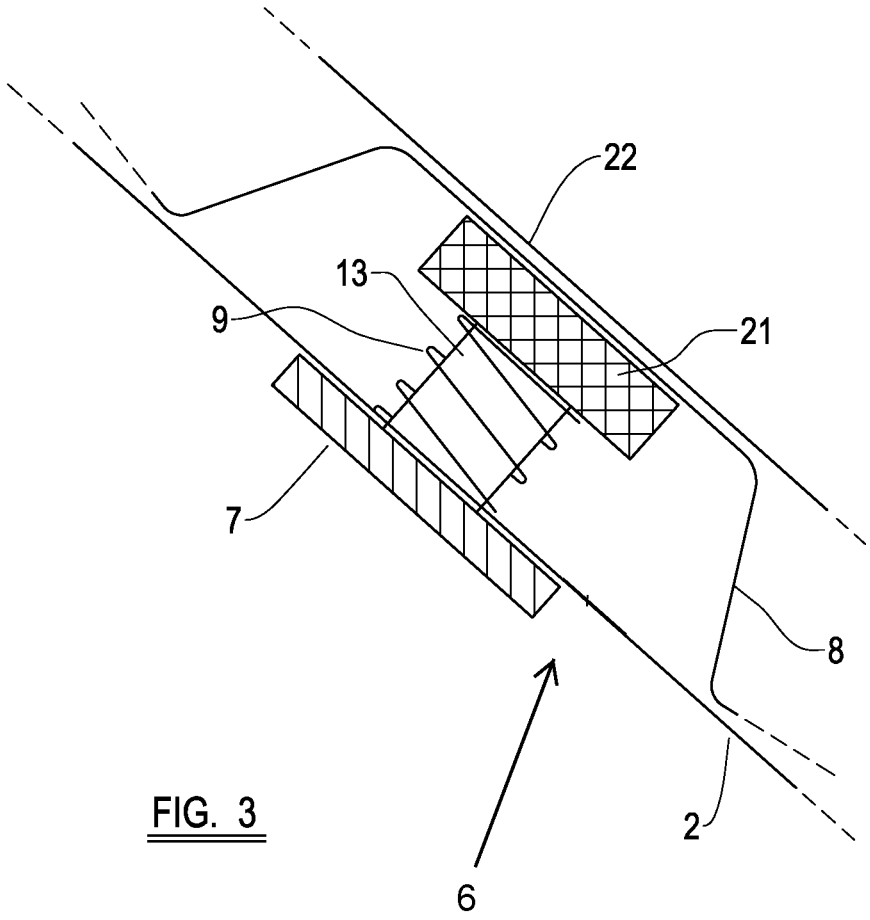
FIG. 3 shows a more detailed view of the brake arrangement and brake button.

In the example shown in FIG. 1, a flexible member in the form of a band 8 runs around the inside of the hollow handle 1, passing around a pair of low-friction lugs 10 positioned inside the grip 2 near the ends thereof which help to guide the band 8 around the interior of the handle 1. Rollers or other similar bearings may be provided in place of or in addition to the lugs 10. Additionally, more than two lugs 10 or rollers may be provided at locations around the inside of the handle 1. The attachment arrangement 4 is rigidly affixed to the band 8. The band 8, and hence the attachment arrangement 4, can be releasably secured in place with respect to the handle 1 by means of a brake assembly 6, which includes a brake button 7, or another convenient type of control element. In an embodiment of the invention, the brake assembly 6 is mounted on the grip 2 and acts on the band 8. The brake assembly 6 is shown in FIG. 3.

An interior part of the brake assembly 6 comprises a clutch member 21, a braking surface of which lies near or against an inner wall 22 of the grip 2. The band 8 passes between the braking surface 21 and the inner wall 22 of the grip 2. The braking surface of the clutch member 21 and/or the inner wall 22 of the grip 2 may have a rubberised or similar surface coating to increase friction on the band 8. The brake button 7 is connected to the clutch member 21 by means of a connecting rod 13 which passes through an aperture in the grip 2. Alternatively, the brake button 7 and clutch member 21 may be formed as one single section, or formed such that a connecting rod 13 is not required. The brake button 7 is presented on an external surface of the grip 2.

In the example shown, the brake assembly 6 is biased toward an active position by means of a spring 9. In the active position, the clutch member 21 presses upon the band 8, locking the band 8 in place and therefore releasably retaining the attachment arrangement 4 so that it may not slide along the mounting portion 3. The brake assembly 6 may be released by pulling outwardly on the brake button 7, releasing the band 8 and allowing the band 8 to slide around the interior of the handle 1, so that the attachment arrangement 4 may be moved to another location on the mounting portion 3. Alternatively, the brake button 7 and therefore the brake 6 may return to an inactive position when pressure on the brake button 7 is released.

Figure 4:
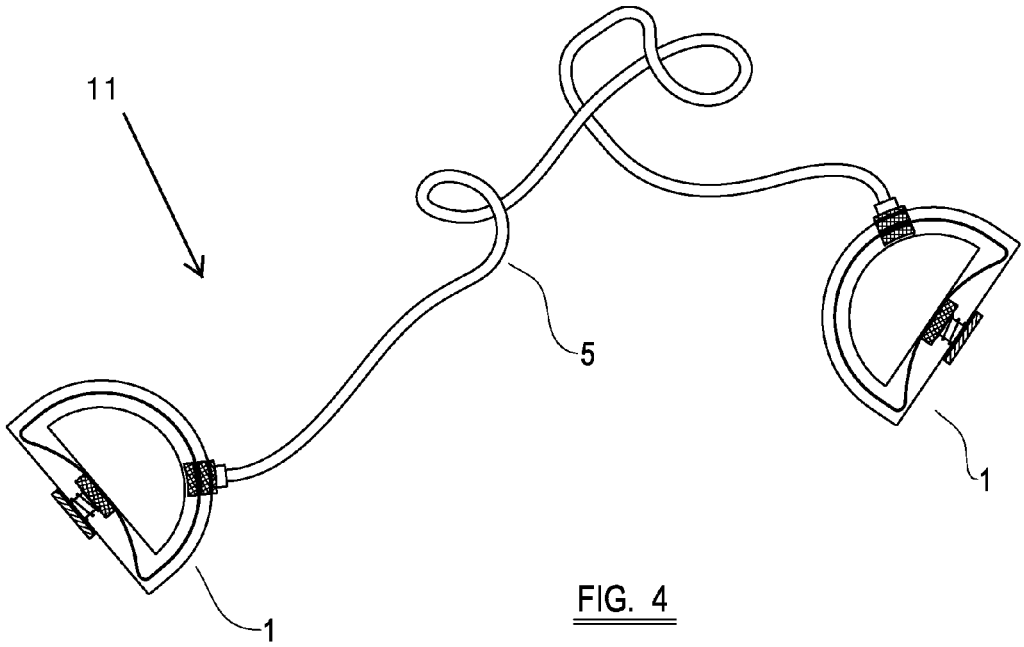
FIG. 4 shows a skipping rope according to the present invention.
Figure 5:
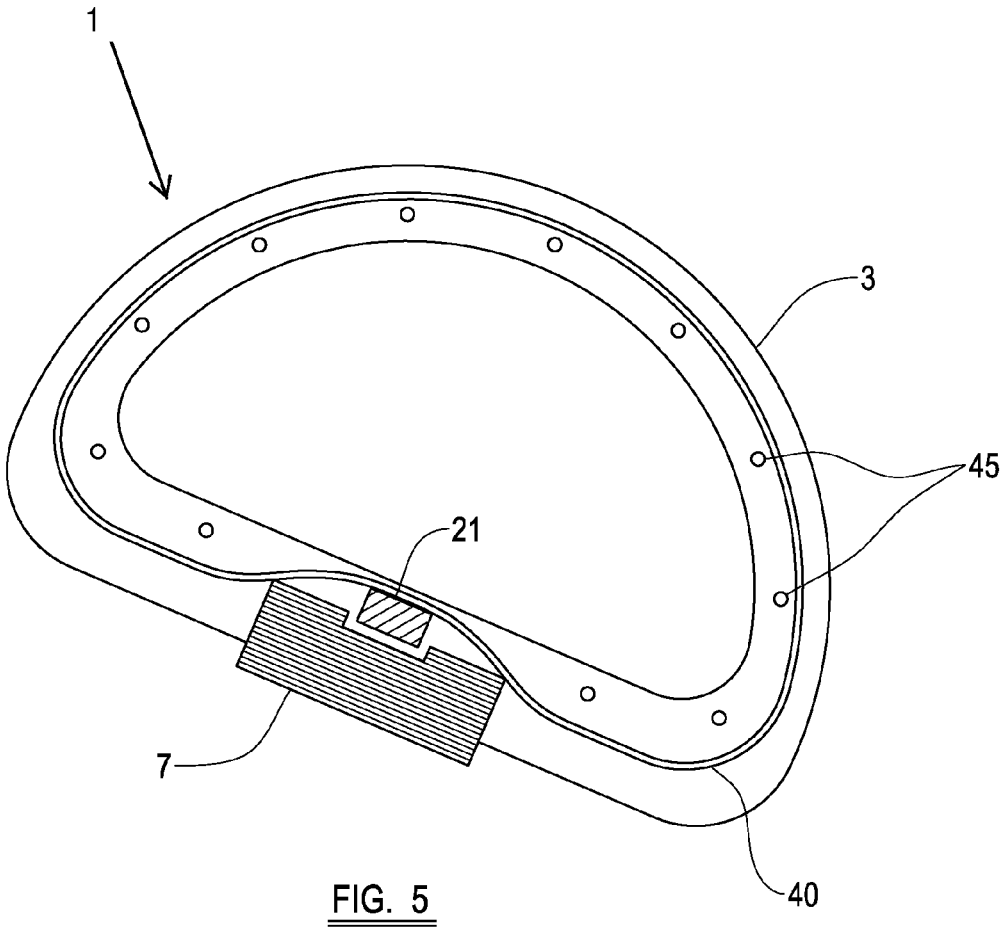
FIG. 5 shows one half of a handle according to the present invention.

Finally, FIG. 4 shows a skipping rope 11 according to the present invention. The skipping rope 11 comprises two handles 1 as described above and a rope 5 attached between the handles 1. In the example shown both of the handles 1 have sliding attachment arrangements 4 to allow the rope 5 to be mounted at different locations along the lengths of the mounting portions 3 of the handles FIG. 5 shows one half of a two-part handle 1, according to the present invention. The band 8 is not shown, but a recess 40 is shown, in which the band 8 would be accommodated. Additionally, pins 45 are shown which are used to secure the two halves of handle 1 together. Complementary recesses are provided in the other half of the handle, to accommodate the pins 45. It is to be appreciated that other, convenient fixing means may be used in place of pins 45, for instance adhesive or screw fixings. The brake button 7 and the clutch member 21 are shown, but a connecting rod 13 is not used.

Use of the skipping rope 11 will now be described.

The user may wish to skip with the skipping rope 11 to work specific muscle groups and target particular areas for muscle development. For example, the user may wish to develop the muscle groups in his/her forearms. To achieve this, the attachment arrangements 4 may be moved along the mounting portions 3 of the handles 1 and locked at particular locations. This will ensure that the forces exerted on the user's arms during skipping will be in the correct direction.

Initially, the brake button 7 and brake assembly 6 will be set in the active position, and to release the brake 6, the user may pull outwardly on the brake button 7, as described above. There may be markings along the mounting portion 3 to indicate to a user where the rope 5 mounting should be locked to work particular muscle groups. The attachment arrangements 4 may be slid along the mounting portions 3 to the desired locations, the brake buttons 7 released, and then a small amount of force applied to the buttons 7 to lock the attachment arrangements 4 in place.

Once the positions of each of the attachment arrangements 4 have been selected and the rope 5 locked in place, the user would then be able to exercise with the skipping rope 11.

It is envisaged that alternative mounting points and handle shapes could be used to achieve the same or similar outcomes, and the locking mechanism set out in the above examples is not the only way to achieve the desired effect. For instance, a ratchet or "lock and key" system could be employed, whereby the attachment arrangement 4 would not be slidable, but releasably locked to the mounting portion 3. The attachment arrangement 4 could be completely detached from the mounting portion 3 and re-positioned in a different location on the mounting portion 3.

In the above description, the attachment arrangement 4 may be locked in place at any point along the length of the slot. However, in other embodiments, a series of spaced apart attachment locations may be defined, with the attachment arrangement 4 being lockable in place at any one of these locations.

It is also envisaged that a skipping rope may be constructed having one handle 1 with an adjustable attachment arrangement 4 and one handle 1 in which the rope is immovably locked in place with respect to the hand grip.

The brake button 7 could alternatively be biased in an outward position so that the default position is the inactive position. In such embodiments, to lock the attachment arrangement 4 in place, a force would need to be applied to the brake button 7, for instance the brake button 7 could be mounted on the grip 2 in a position to enable it to be pressed by the palm of the user during normal skipping.

The rope or cord 5 may be affixed to the mounting portion 3 in any number of ways, and the examples given herein are not intended to be exhaustive nor limiting. The rope or cord 5 would likely need to be mounted to the connection portion 33 by means of a bearing, to allow free rotary movement of the rope or cord 5 during normal skipping. It is envisaged that different ropes could be used with the handles 1 to cater for different types of skipping activities to focus on training for different sports.

Furthermore, a handle incorporating the brake button and assembly could be used in connection with other exercise devices or methods, for instance with a weight training machine or resistance work-out system to a similar effect to work specific muscle groups.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A skipping rope having at least one handle comprising:

an elongate grip having a length extending along a first axis from a first end to a second end;

a mounting portion which is fixed to the grip and having a length, at least part of the mounting portion being spaced apart from the grip, wherein at least a part of the mounting portion's length extends along a second axis;

an attachment arrangement configured to affix a rope or cord to the mounting portion at any of a plurality of locations within a range of locations along the mounting portion's length;

a brake assembly allowing the attachment arrangement to be releasably secured in position; and a flexible member that is capable of moving within the handle and to which the attachment arrangement is fixed, wherein the brake assembly acts to prevent movement of the flexible member within the handle and thus substantially prevents movement of the attachment arrangement with respect to the mounting portion.

2. A skipping rope according to claim 1, wherein:

the mounting portion extends over the grip; and the grip and mounting portion define a space therebetween capable of accommodating a plurality of fingers or a palm of a user.

3. A skipping rope according to claim 2, wherein the mounting portion extends from a point at or near the first end of the grip, to a point at or near the second end of the grip.

4. A skipping rope according to claim 1, wherein the attachment arrangement is configured to slide within a range of motion along all or a part of the length of the mounting portion and may be locked in place at any point within this range of motion.

5. A skipping rope according to claim 1, wherein the attachment arrangement is configured to be locked into any one of a plurality of spaced apart attachment points along the length of the mounting portion.

6. A skipping rope according to claim 1 wherein the brake assembly includes a control element to engage or release the brake assembly.

7. A skipping rope according to claim 6 wherein the control element is provided on the grip.

8. A skipping rope according to claim 7 wherein the control element comprises a button configured to be pressed by a user when holding the grip during normal skipping.

9. A skipping rope according to claim 1, wherein the skipping rope further comprises two handles and a length of rope or cord extending therebetween.

10. An exercise device handle, the handle comprising:

an elongate grip;

a mounting portion which is fixed to the grip;

an attachment arrangement by which a rope or cord is affixed to the mounting portion; and a brake assembly allowing the attachment arrangement to be releasably secured at any of a range of locations along a length of the mounting portion, the brake assembly comprising a control element which is configured to be manipulated to engage or release the brake assembly, the control element being located on the grip.

11. A handle according to claim 10, wherein the grip has a first and second end, wherein the mounting portion extends over the grip, and wherein the grip and mounting portion define a space therebetween configured to accommodate fingers or a palm of a user.

12. A handle according to claim 11, wherein the mounting portion extends over the grip from a point at or near the first end of the grip, to a point at or near the second end of the grip.

13. A handle according to claim 10, wherein the control element is biased toward an active position, in which the brake assembly is engaged.

14. A handle according to claim 10, wherein the control element is biased toward an inactive position, in which the brake assembly is disengaged.

15. A handle according to claim 10, further comprising a flexible member that capable of moving within the handle and to which the attachment arrangement is fixed, wherein the brake assembly acts to prevent movement of the flexible member within the handle and thus substantially prevents movement of the attachment arrangement with respect to the mounting portion.

16. A handle according to claim 10, wherein the mounting portion of the handle is of a generally curved shape.

17. A handle according to claim 10, wherein the attachment arrangement capable of sliding a range of motion along all or part of the length of the mounting portion and may be locked in place at any point within this range of motion.

18. A handle according to claim 10, wherein a location at which the attachment arrangement is configured to be secured in one of a set of spaced-apart pre-defined locations.

19. A handle according to claim 10, wherein the handle is attached to an exercise device.

20. A handle according to claim 19, wherein the exercise device is a skipping rope.

* * * * *